US005887388A

United States Patent [19]

Hempel et al.

[11] Patent Number: 5,887,388

[45] Date of Patent: Mar. 30, 1999

[54] IN-THE-ROOM FIREPLACE SYSTEM

[75] Inventors: Rodney A. Hempel, Marriottsville; Jeffrey S. Grundy, Baltimore, both of Md.

[73] Assignee: Thulman Eastern Corporation, Annapolis Junction, Md.

[21] Appl. No.: 786,155

[22] Filed: Jan. 21, 1997

[51] Int. Cl.[6] ..... F24C 15/08; G01B 3/14

[52] U.S. Cl. ..... 52/27; 52/105; 52/127.1; 52/741.1; 52/747.1; 33/562; 126/278; 248/346.01

[58] Field of Search ..... 52/27, 105, 127.1, 52/363, 747.1, 741.1; 126/278; 33/562; 248/346.01

[56] References Cited

U.S. PATENT DOCUMENTS

| | | |
|---|---|---|
| 2,610,413 | 9/1952 | Dasey . |
| 3,082,651 | 3/1963 | Patrick, Jr. . |
| 4,384,565 | 5/1983 | Scholz et al. . |
| 4,443,949 | 4/1984 | Newton . |
| 4,589,211 | 5/1986 | Policka . |
| 4,700,687 | 10/1987 | Bailey et al. . |
| 4,802,284 | 2/1989 | Jackson . |
| 5,142,787 | 9/1992 | Dadisman . |
| 5,157,844 | 10/1992 | Mallison et al. . |
| 5,195,249 | 3/1993 | Jackson . |
| 5,222,303 | 6/1993 | Jardine . |
| 5,249,567 | 10/1993 | Maitland et al. . |
| 5,367,783 | 11/1994 | Nygren . |

OTHER PUBLICATIONS

Empire Comfort Systems, "Vent–Free Gas Fireplaces" (Sep. 1996).

Martin Fireplaces, "Your HOme Deserves an Ovation" (Nov. 1994).

Martin Fireplaces, "Martin Gives Freedom New Meaning" (Nov. 1994).

The Majestic Products Company, "The Insta–Flame Wall System".

Thulman Eastern, "First in Fireplaces".

*Primary Examiner*—Christopher Kent

*Attorney, Agent, or Firm*—Hoffmann & Baron, LLP

[57] ABSTRACT

A template and method of installation of an in-the-room gas fireplace and associated cabinetry. The template coordinates the initial positioning of the gas fireplace unit, and additionally ensures that subsequently-installed plumbing and electrical connections will not obstruct or interfere with the associated cabinetry.

20 Claims, 22 Drawing Sheets

IN-THE-ROOM FIREPLACE SYSTEM

BACKGROUND OF THE INVENTION

The present invention relates to a fireplace system and, more particularly, to the installation of a gas fireplace, and associated cabinetry.

Conventional woodburning fireplaces have been used in homes throughout the years. Although these fireplaces are not usually the primary heating source in todays homes, such fireplaces remain quite popular due to their aesthetic value and charm. Conventional woodburning fireplaces, of course, require some type of chimney for venting of the combustion products. As will be appreciated by those skilled in the art, conventional fireplaces are typically built with an outside masonry chimney. Prefabricated woodburning fireplaces typically have metal chimneys that are installed in an outside chimney chase. In newer construction, these chimneys are often framed, and thereafter covered by siding.

In recent years, there has been a trend towards the installation of gas fireplaces. These gas fireplaces typically burn cleaner, can be turned on and off with the push of a button, eliminate the need for buying, chopping and storing wood and require little or no maintenance and/or cleaning. Such gas fireplaces were originally installed in similar fashion to conventional woodburning fireplaces, i.e., they were typically installed in outside chases. However, newer gas fireplace technology allows the fireplace to be moved into the room, rather than being enclosed in an outside chimney chase. These newer fireplaces include both direct vent and vent free models.

However, the introduction of these "in-the-room" fireplaces has introduced a number of installation problems. As will be appreciated by those skilled in the art, the installation of a gas fireplace in a home under construction requires the interaction of multiple tradesmen, who are commonly unknown to one another and often work during non-overlapping periods of time during the construction process. Inasmuch as a gas fireplace must be bolted to the floor prior to any of the plumbing or electrical connections, and prior to any of the finishing work such as drywall and cabinetry, installation problems are common. By way of example, installation problems include improperly located fireplaces, improperly located gas lines, improperly located vent lines, damage to gas/vent lines during subsequent construction and/or improper fit of finishing materials and/or cabinetry.

There is therefore a need in the art for a fireplace system and installation method therefor which encompasses the complete installation of a gas fireplace from the initial positioning of such fireplace on the floor of the home to the final installation of the finished cabinetry or other millwork.

SUMMARY OF THE INVENTION

As a result, the present invention provides a template for facilitating installation of a gas fireplace unit in a building. The template includes a planar panel having an upper surface for receipt of the gas fireplace unit thereon. The panel further includes a lower surface for engagement with the floor and a rearward edge for abutment against the studs of the wall. The upper surface of the panel includes means for locating the gas fireplace at a predetermined position thereon. The template further includes a drywall cavity sized for receipt of drywall therein located along the rearward edge of the panel. Finally, the template includes at least one predefined access opening in either the panel or the flange which is adapted for passage of a gas line therethrough.

The present invention also relates to a method of installing a gas fireplace unit in a building. The method includes the step of providing a template. The template includes a planar panel having an upper surface for receipt of the gas fireplace unit thereon, a lower surface for engagement with the floor and a rearward edge for abutment against the studs. The template further includes a drywall cavity sized for receipt of drywall therein located along the rearward edge of the panel. Finally, the template includes an upper surface including means for locating the gas fireplace unit at a predetermined position thereon. The method includes the further step of locating the template on the floor of a building and thereafter positioning the rearward edge into abutting contact with the studs of the wall. The method includes the further step of securing the template to the floor. The method additionally includes the step of locating the fireplace unit at the predetermined position on the panel. Finally, the method includes the step of running a gas line through a predefined opening in the template and thereafter connecting the gas line to the fireplace unit.

As a result, the present invention provides a fireplace system and installation method therefore which encompasses the complete installation of a gas fireplace from the initial positioning of such fireplace on the floor of the home to the final installation of the finished cabinetry or other millwork. As a result, the finishing off of the fireplace is coordinated fully at the time the fireplace is roughed in, thus avoiding fit and finish problems which would otherwise result in additional costs and or delay during subsequent construction.

DETAILED DESCRIPTION OF THE INVENTION

Figure 1:
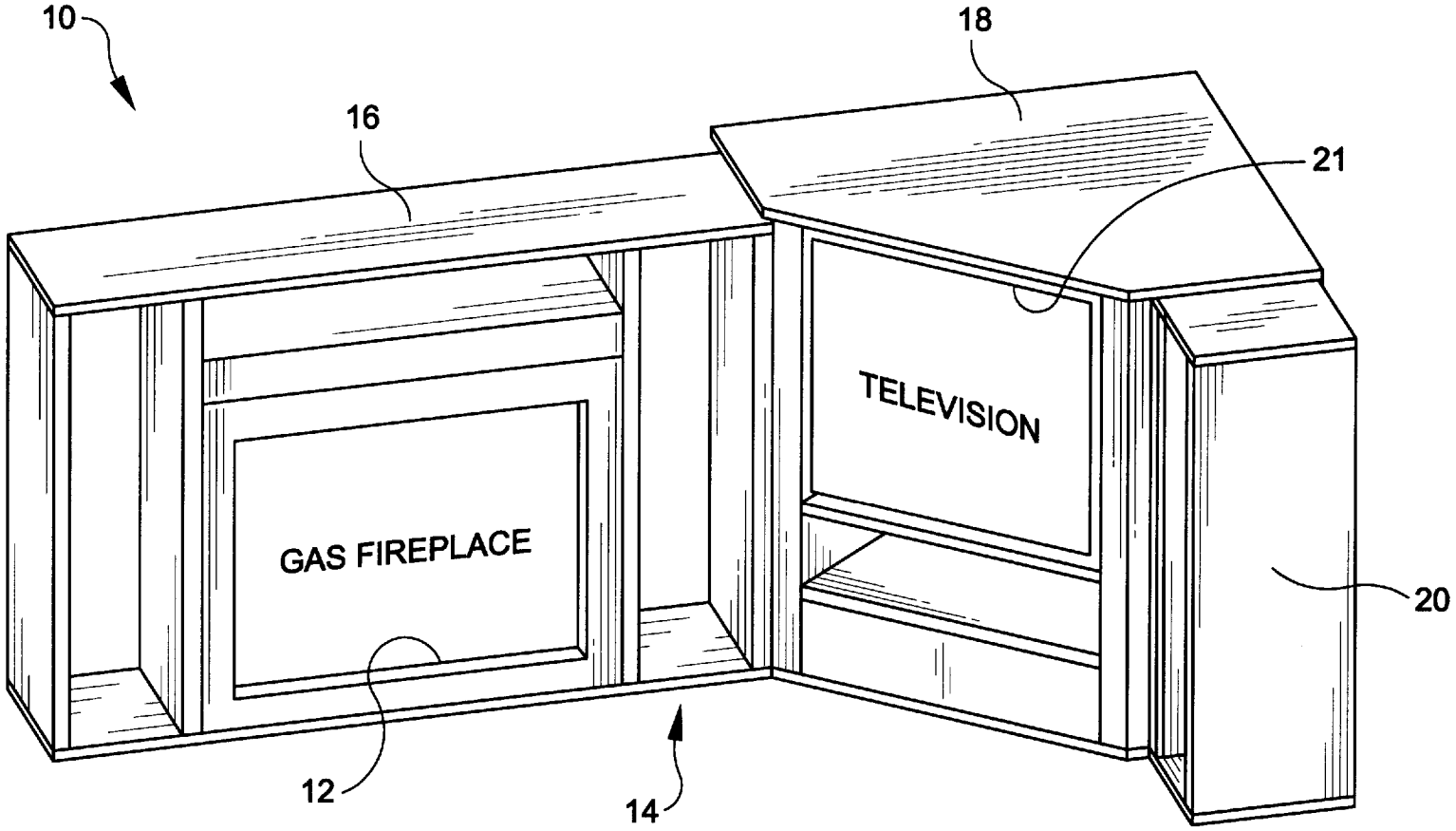
FIG. 1 is a perspective view of a fireplace system in accordance with the present invention.

An "in-the-house" home fireplace system 10 is shown in FIG. 1. System 10 is located entirely interior of the outer walls of the home. System 10 includes a gas fireplace 12 and associated cabinetry 14. More particularly, cabinetry 14 includes fireplace cabinet unit 16, corner cabinet unit 18 and bookcase cabinet unit 20. In one embodiment, corner cabinet unit 18 is sized to hold a television 21 and other electronic equipment such as a video tape player (not shown).

Figure 2:
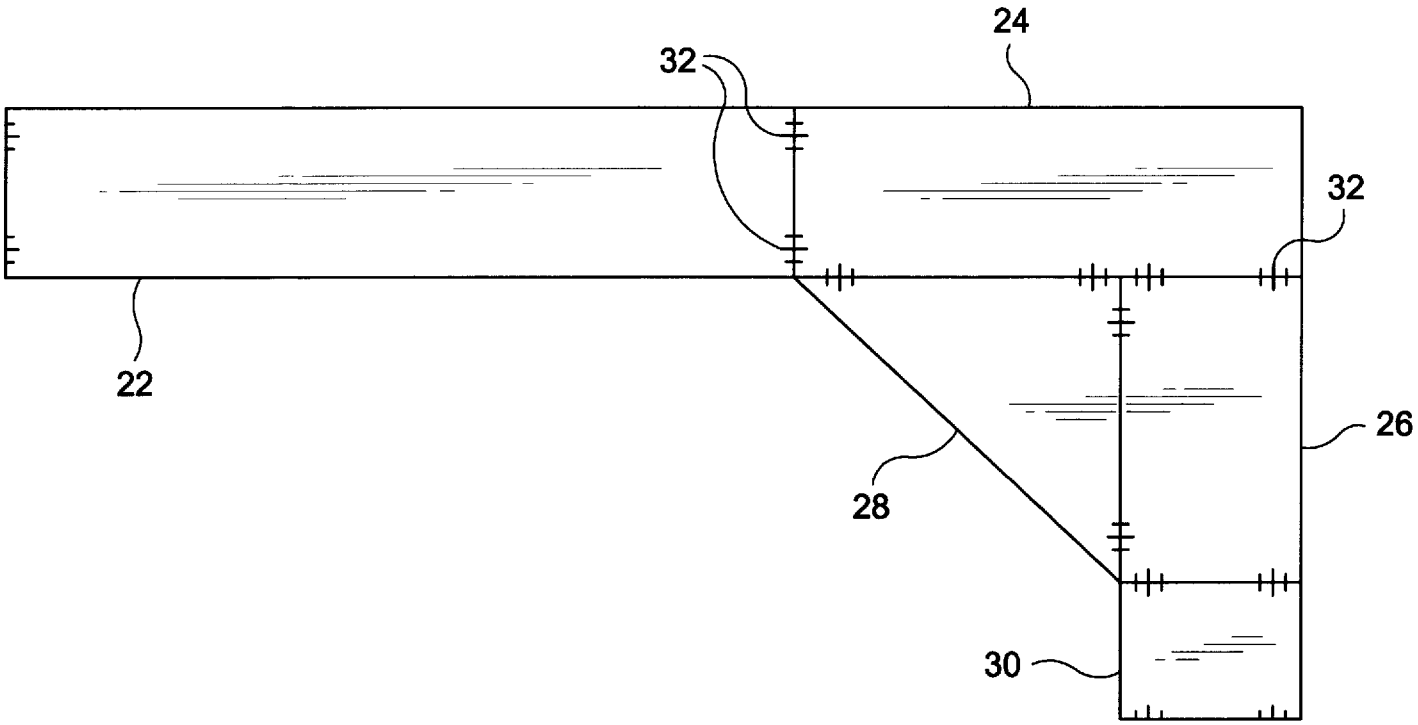
FIG. 2 is a plan view of the floor layout of the fireplace system of FIG. 1.

The floor layout of system 10 is shown in FIG. 2. In this regard, the present invention provides a new and useful in-the-room fireplace system and method for installation thereof (including any associated cabinetry) in new home construction, thus overcoming the problems (e.g., improper fireplace location, improper vented gas line location, improper or damaged cabinetry) commonly associated with prior art installations. The fireplace system described herein includes at least one installation template which coordinates at the time the fireplace unit is roughed in all subsequent fittings and finishing. The template thereby ensures that the fireplace is secured in precisely the correct location for receipt of subsequent gas lines, vent lines, electrical outlets and cabinetry. Thus, fit and finish problems which result in additional cost and/or time are eliminated.

Referring to FIG. 2, each cabinetry unit includes an installation template. For example, fireplace cabinet unit 16 includes template 22, corner cabinet unit 18 includes templates 24, 26 and 28, and bookcase cabinet unit 20 includes template 30. As shown, the various templates may be secured to one another by, for example, a plurality of cam locking pins 32. Once the various templates are secured to one another, the combined template is positioned at its proper location and secured to the subfloor. This may be accomplished by nails, screws, glue or other suitable means.

Figure 3:
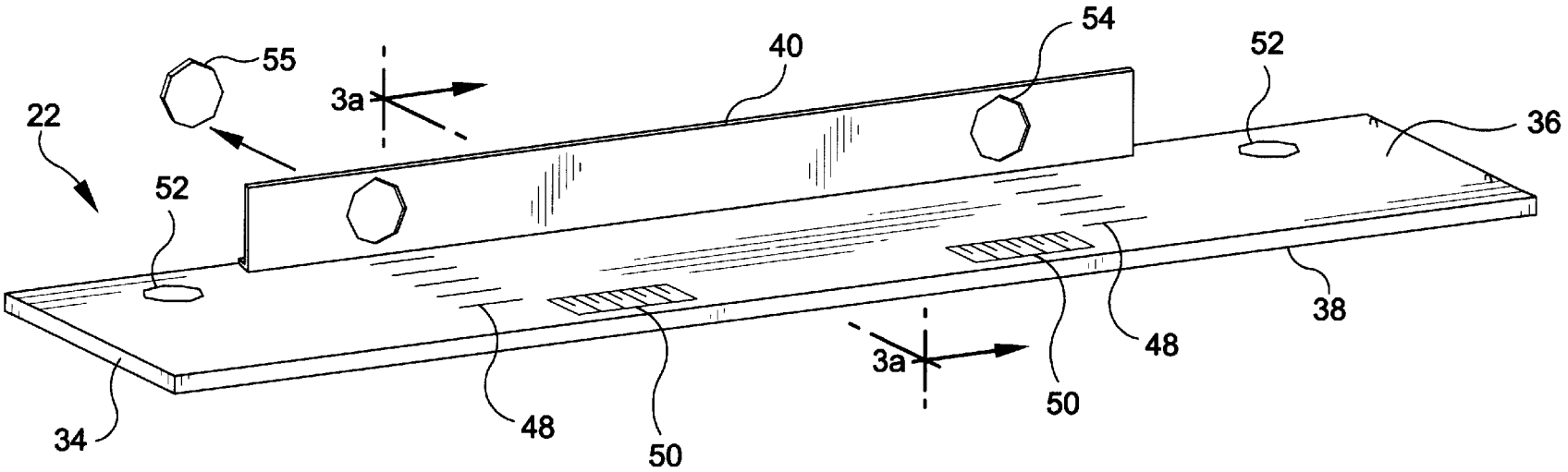
FIG. 3 is a perspective view of the fireplace cabinet template.
Figure 3A:
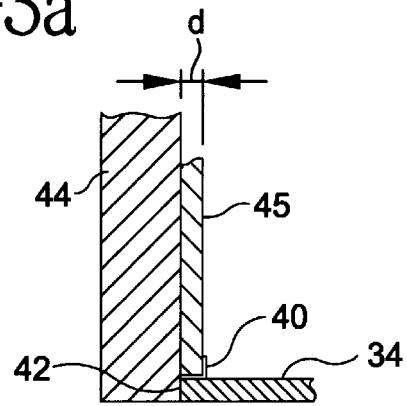
FIG. 3*a* is a sectional view taken along lines 3*a*—3*a* of FIG. 3.

By way of example, template 22 is shown in detail in FIG. 3. Template 22 includes a planar panel 34 having an upper surface 36 for receipt of the fireplace thereon, and a lower surface 38 for engagement with the subfloor of the home. Template 22 further includes a drywall flange 40 secured to upper surface 36. As shown in FIG. 3*a*, flange 40 is set back from rearward edge 42 of panel 34 a distance d as to allow the rearward edge to abut and thus contact studs 44. Distance d corresponds to the thickness of the drywall 45, commonly ⅝ of an inch. As a result, a drywall cavity sized for receipt of drywall is defined along the rearward edge of the panel. It is contemplated herein that this drywall cavity may also be created by notching the rearward edge of the panel or in other similar fashion.

Figure 4:
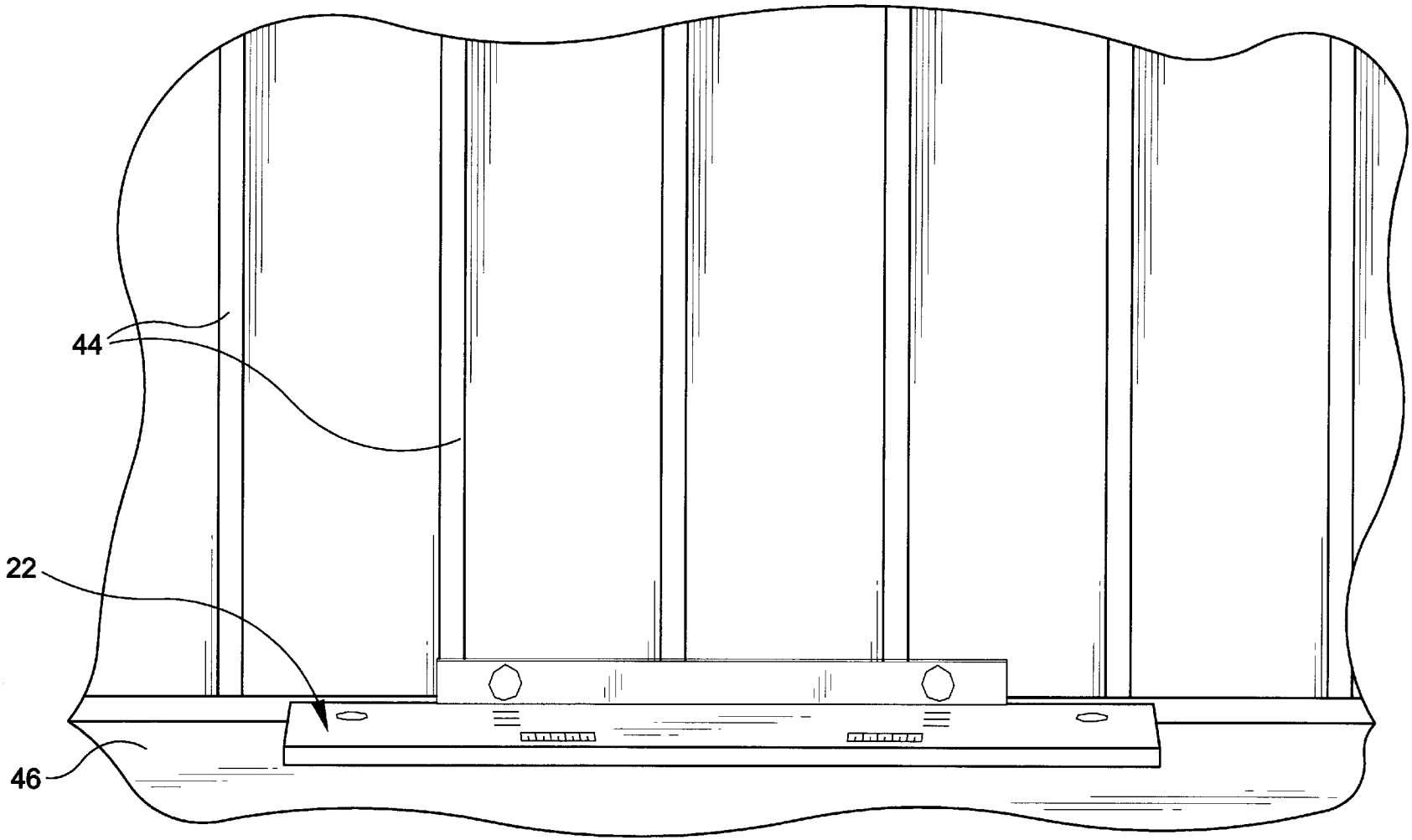
FIG. 4 is a perspective view of the fireplace cabinet template installed on the floor of a building and positioned in abutting contact with the studs of a wall in the building.
Figure 5:
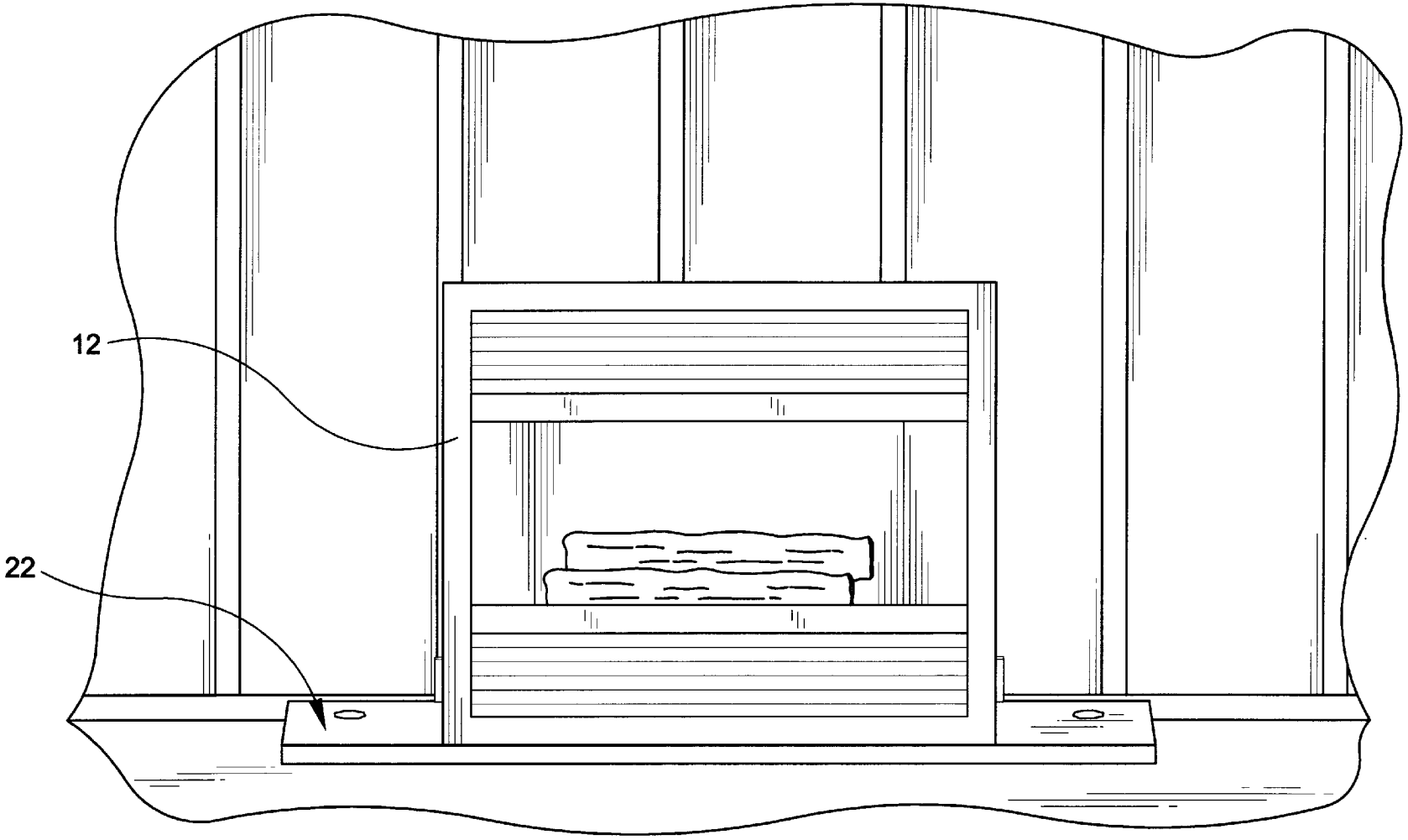
FIG. 5 is a perspective view of a gas fireplace unit installed on the template.
Figure 6:
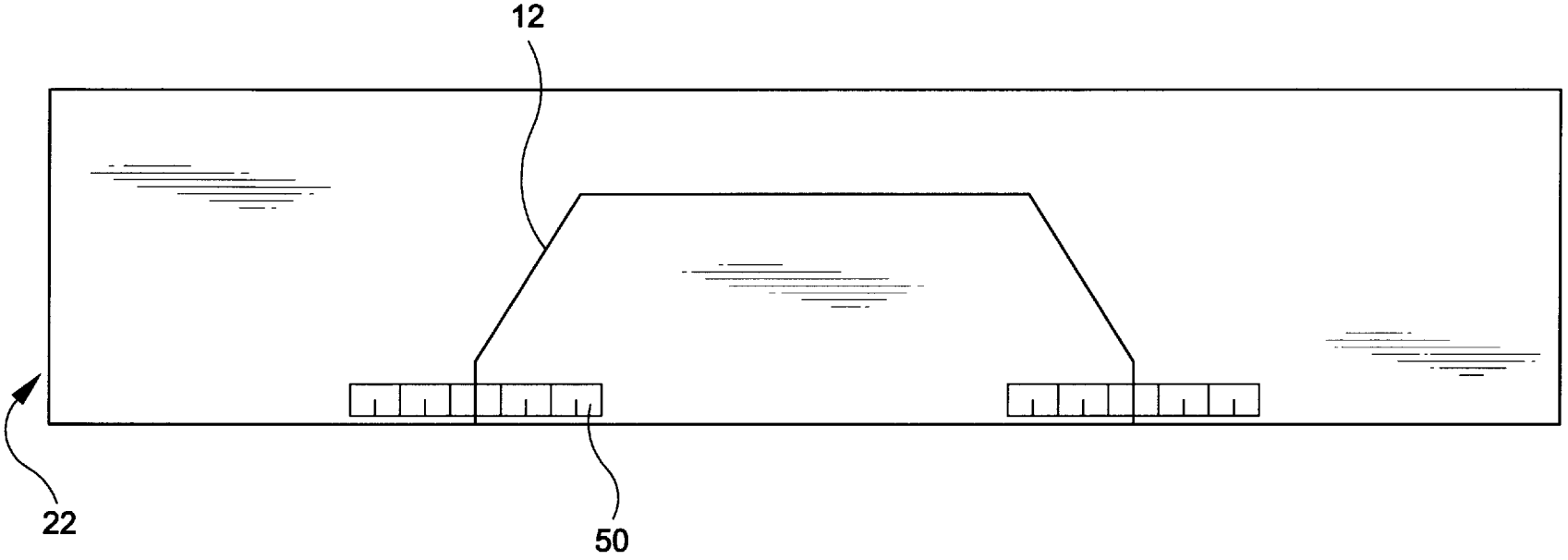
FIG. 6 is a plan view of the gas fireplace centered on the template by reference to lengthwise measuring marks.

Now referring to FIG. 4, template 22 is shown secured to floor 46 and in abutting contact with studs 44 (templates 24, 26, 28 and 30 having been removed for clarity). As shown in FIG. 5, fireplace 12 is thereafter positioned on template 22 and anchored thereto. To ensure that the fireplace is positioned at the proper location, surface 36 includes transverse measuring marks 48 and lengthwise measuring marks 50 (see FIG. 3). Now referring to FIG. 6, marks 50 are located on both sides of the center of the template and are graduated in inches to facilitate the placement of the fireplace unit. The fireplace is therefore centered on the template by reference to marks 50. Of course, it is contemplated herein that the template may include other means such as predrilled holes, detents, guide strips, etc., for properly locating the gas fireplace thereon. Moreover, the fireplace should be both plumb and level, which may require shimming of the fireplace.

Thereafter, the appropriate vent line is installed, if the fireplace unit requires such venting. A plumber then connects the necessary gas line. In this regard, the plumber makes use of the plurality of predefined plumbing access holes 52, 54 (see FIG. 3) by choosing the access hole most convenient for that particular installation. By running the gas line through a predefined opening, the plumber can be confident that the installed gas line will not interfere with the subsequently-installed drywall and cabinetry. In one preferred embodiment, access holes 54 are formed in the flange as removable knockouts 55.

Thereafter, an electrician performs the rough electrical wiring (assuming the installation will require electrical outlets - for example, to power television 21). To ensure proper installation and to guide the tradesmen, all installation instructions are printed on the template. In addition, various installation schematics are also printed on the template. Thus, both the plumber and electrician will be informed of the proper installation technique prior to beginning his work, even in the absence of any outside instruction.

Figure 7:
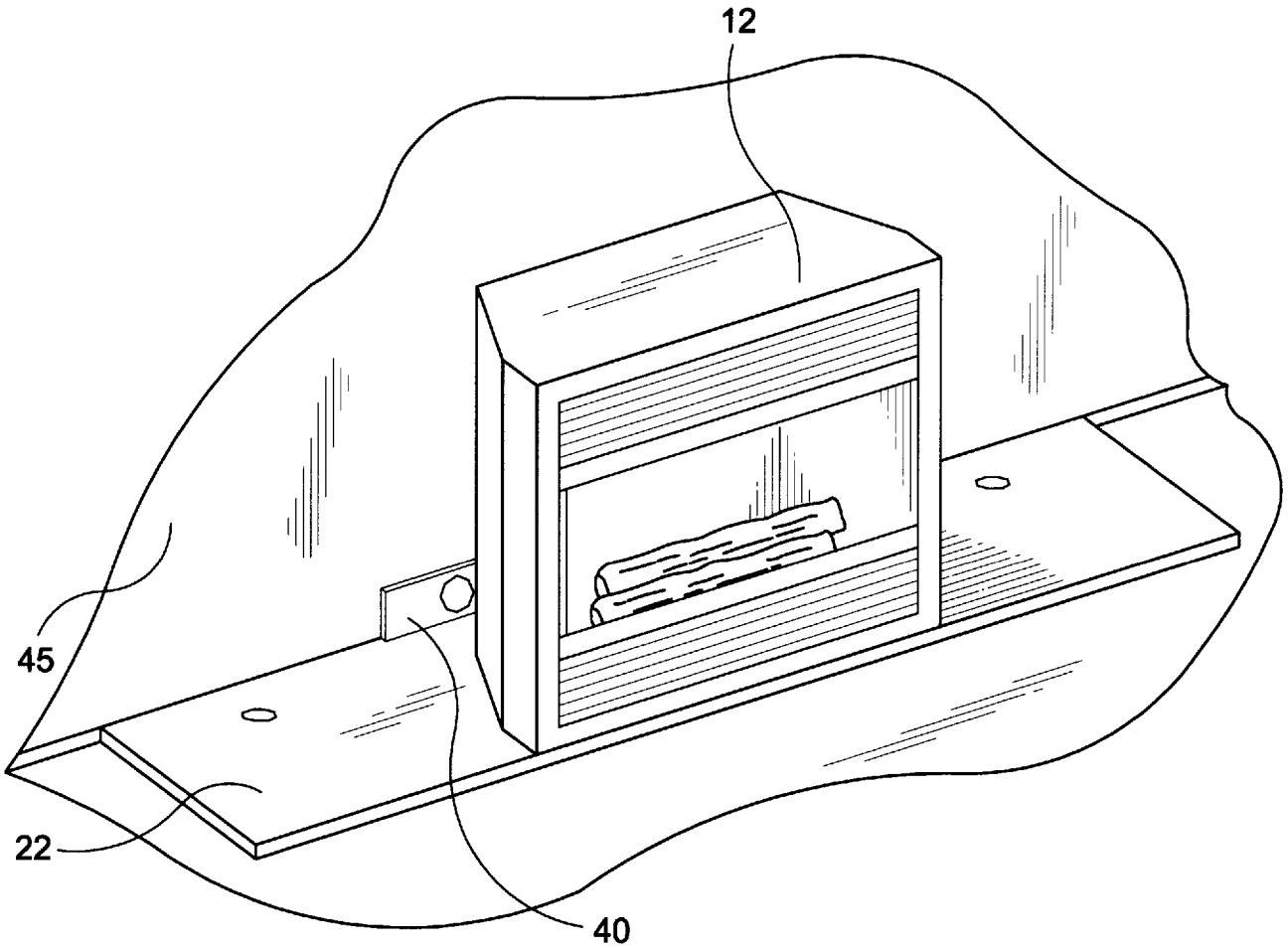
FIG. 7 is a perspective view of the template and gas fireplace after drywall has been attached to the studs of the wall.
Figure 8:
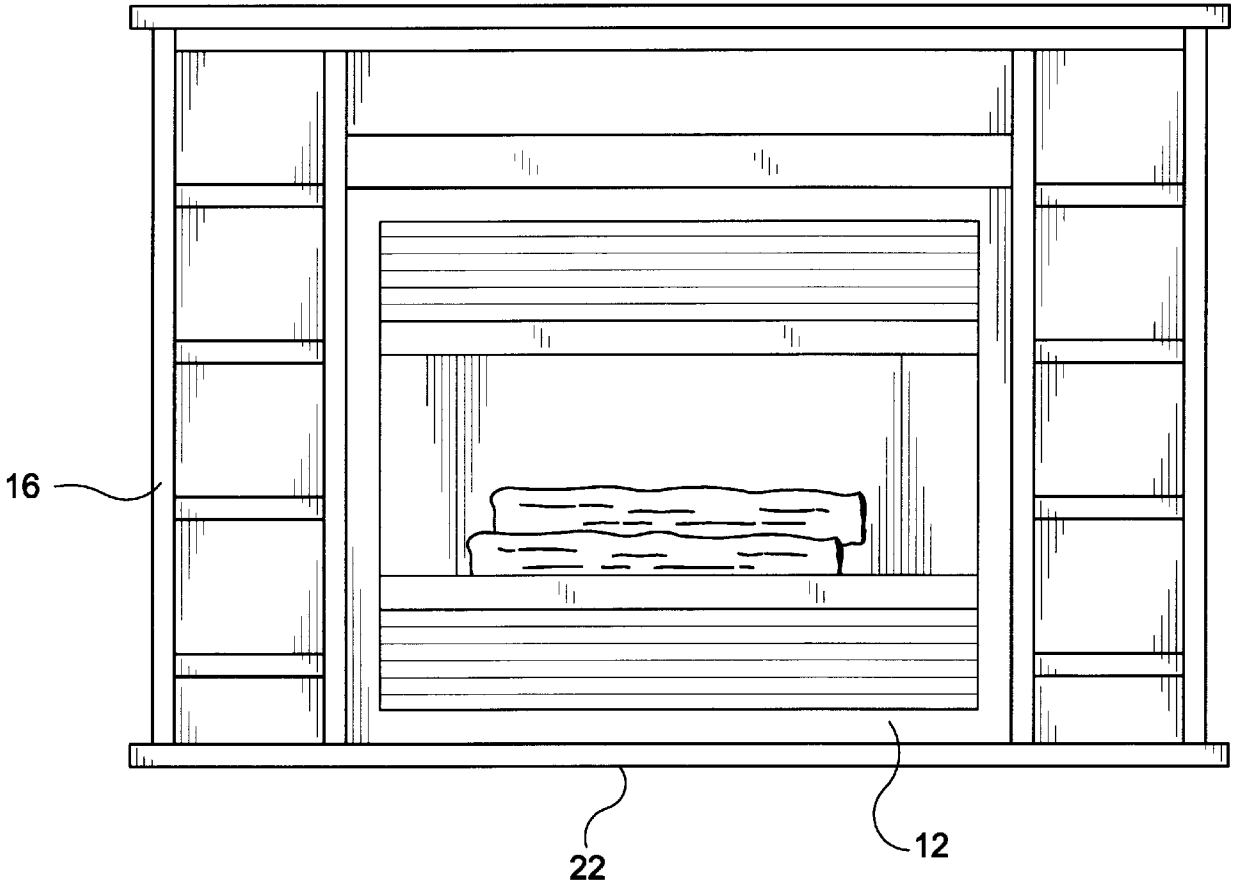
FIG. 8 is a front elevational view of the fireplace after installation of the associate cabinetry therearound.

As shown in FIG. 7, drywall 45 is then attached to studs 44. As described hereinabove, drywall 45 slides behind flange 40. Finally, as shown in FIG. 8, the cabinetry is installed around fireplace 12. In one particularly preferred embodiment, fireplace cabinet unit 16 is secured to template 22 by cam lock pins 32. Marble facing or other appropriate finishing material may then be installed around the periphery of fireplace 12. Finally, any necessary finish electrical work is accomplished, e.g., installation of electrical cover plates.

Figure 9A:
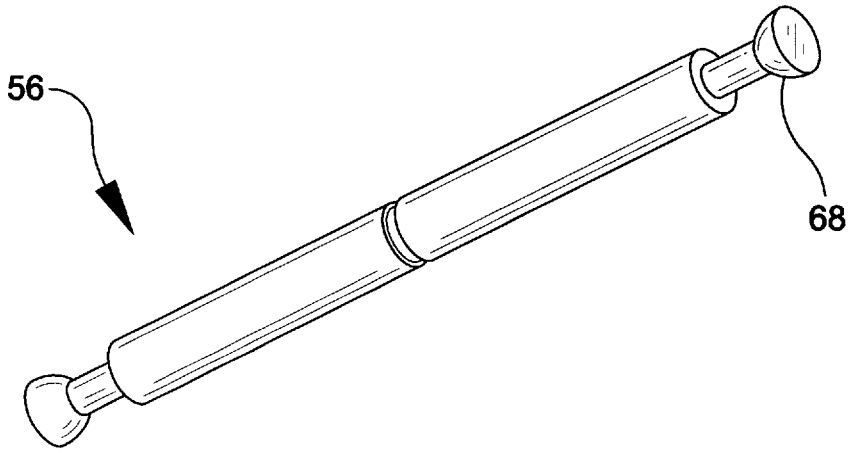
FIG. 9*a* is a perspective view of a camlock pin having heads at opposing ends.
Figure 9B:
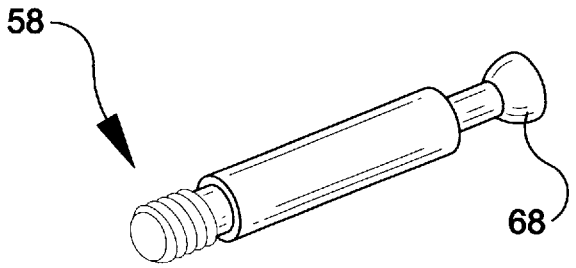
FIG. 9*b* is a perspective view of a camlock pin having a head at one end and threads at the opposing end.
Figure 9D:
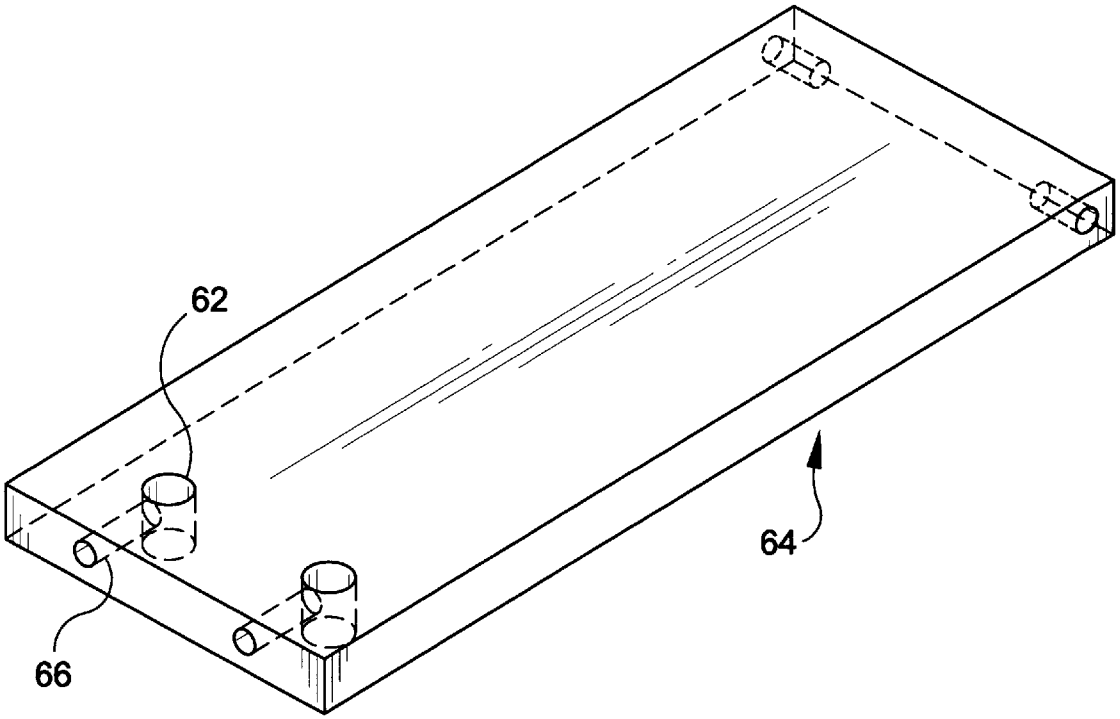
FIG. 9*d* is a perspective view of a cabinet panel adapted for receipt of camlock fastening systems.
Figure 9C:
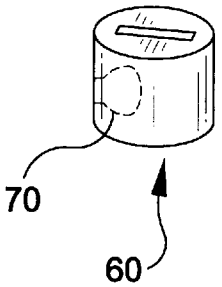
FIG. 9*c* is a perspective view of a rotatable camlock.
Figure 10A:
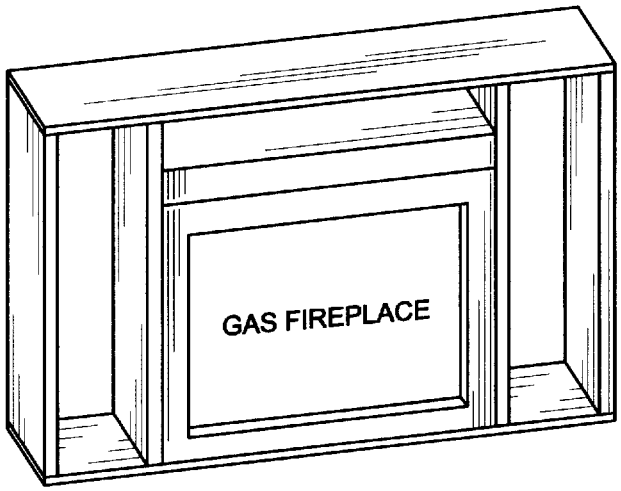
FIGS. 10*a*–10*g* illustrate various configurations which may be accomplished utilizing the cabinet components of FIG. 1.
Figure 10B:
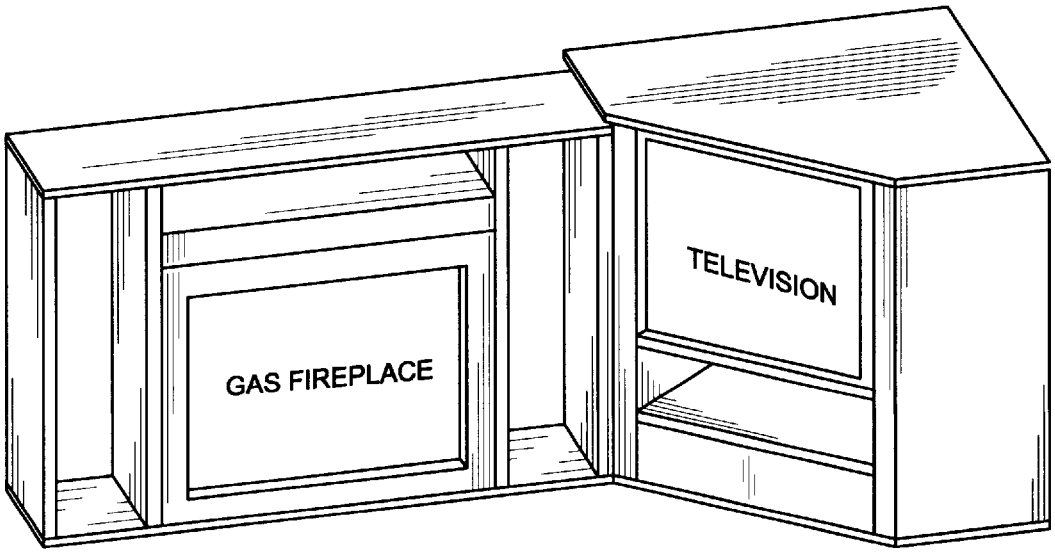
Figure 10C:
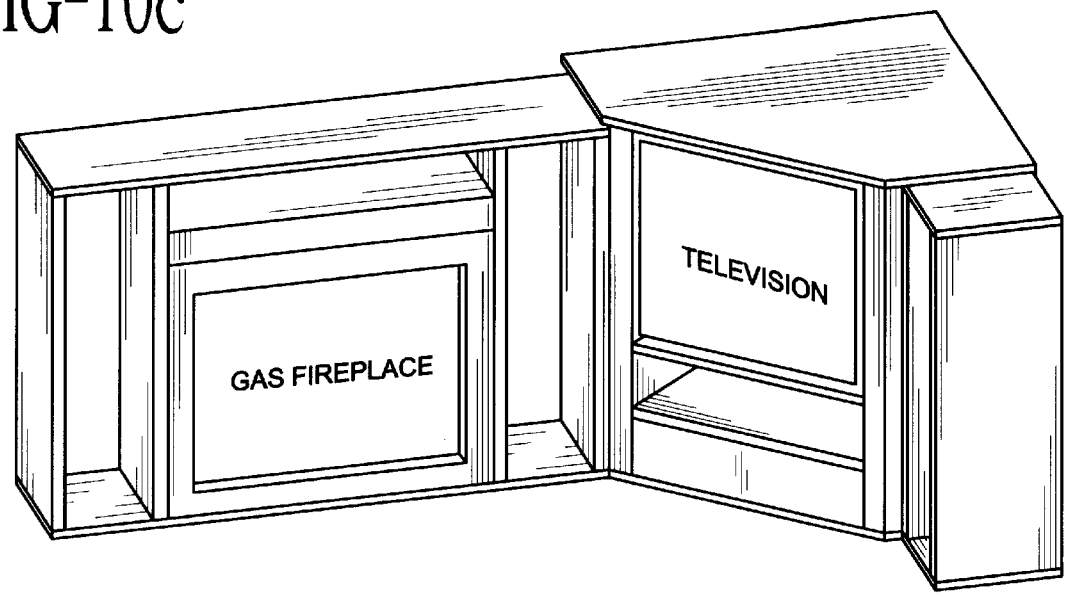
Figure 10D:
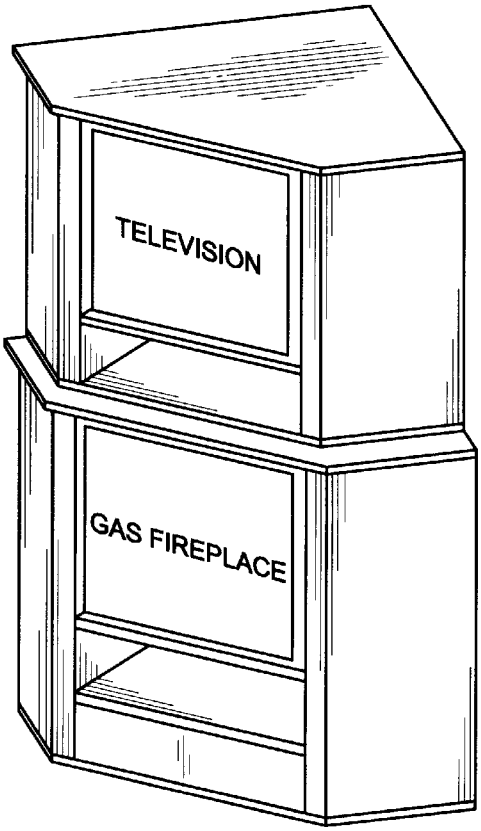
Figure 10E:
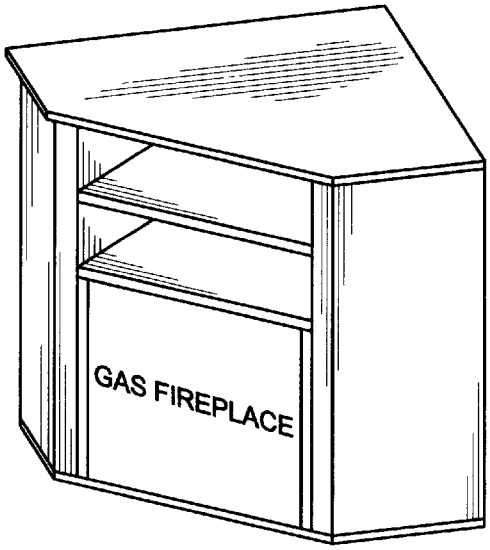
Figure 10F:
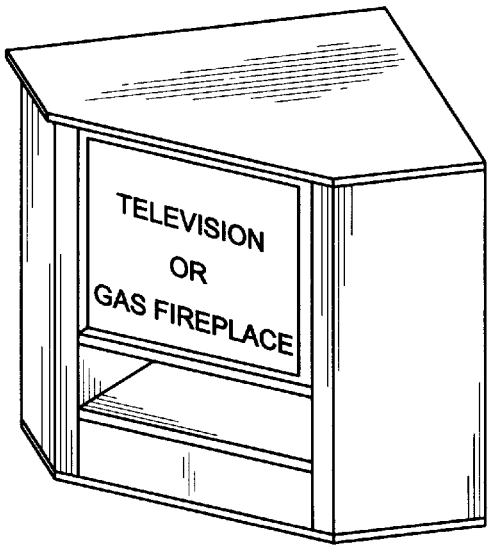
Figure 10G:
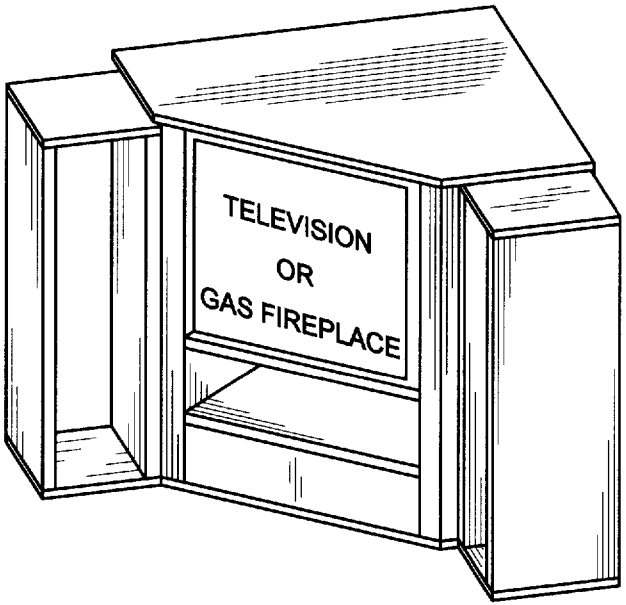

Camlock pins 56, 58 are shown in FIGS. 9*a* and 9*b*, respectively. As will be appreciated by those skilled in the art, the pins are used in conjunction with rotatable camlocks 60 (shown in FIG. 9*c*) which are insertable in, for example, blind holes 62 of cabinet panel 64. The camlock pin is then inserted into passage 66 until head 68 is received by keyhole 70 of the camlock. Thereafter, the camlock is turned to the lock the head therein. A second camlock pin is inserted into the other passage, and this pin is similarly locked in place. The panel can the be secured to an adjacent panel in similar fashion. If camlock pins 58 are utilized (which include one threaded male end), the adjacent panel would be provided with threaded female inserts.

Figure 11:
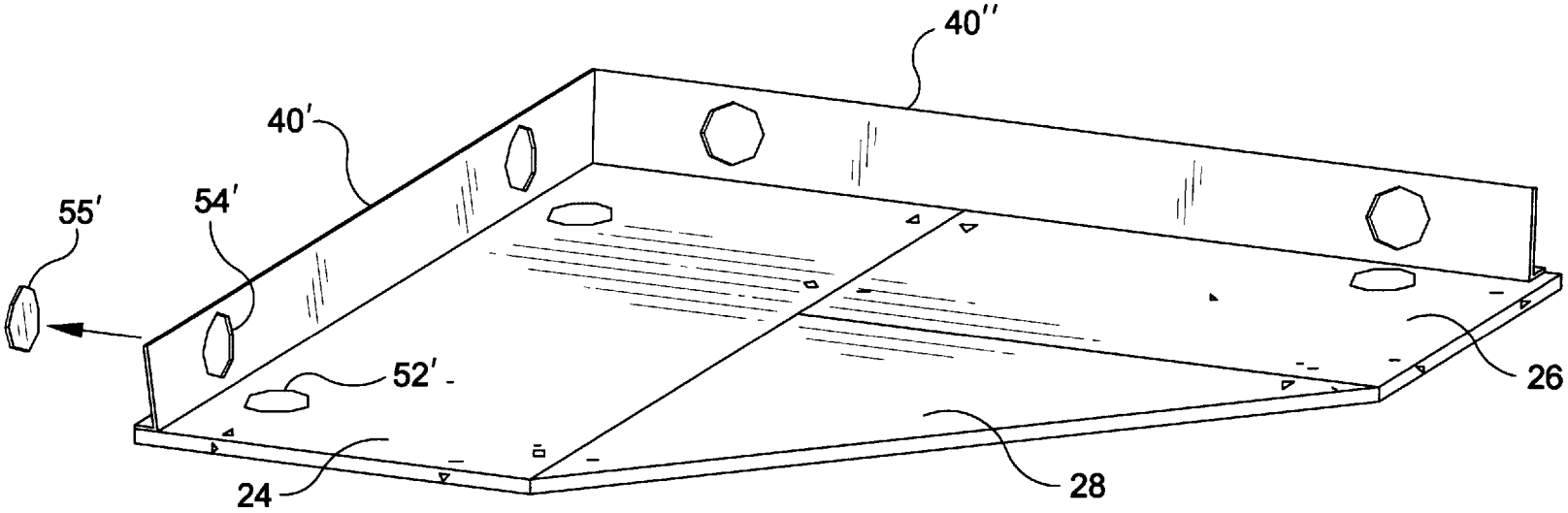
FIG. 11 is a perspective view of an installation template utilized for a corner installation.
Figure 12:
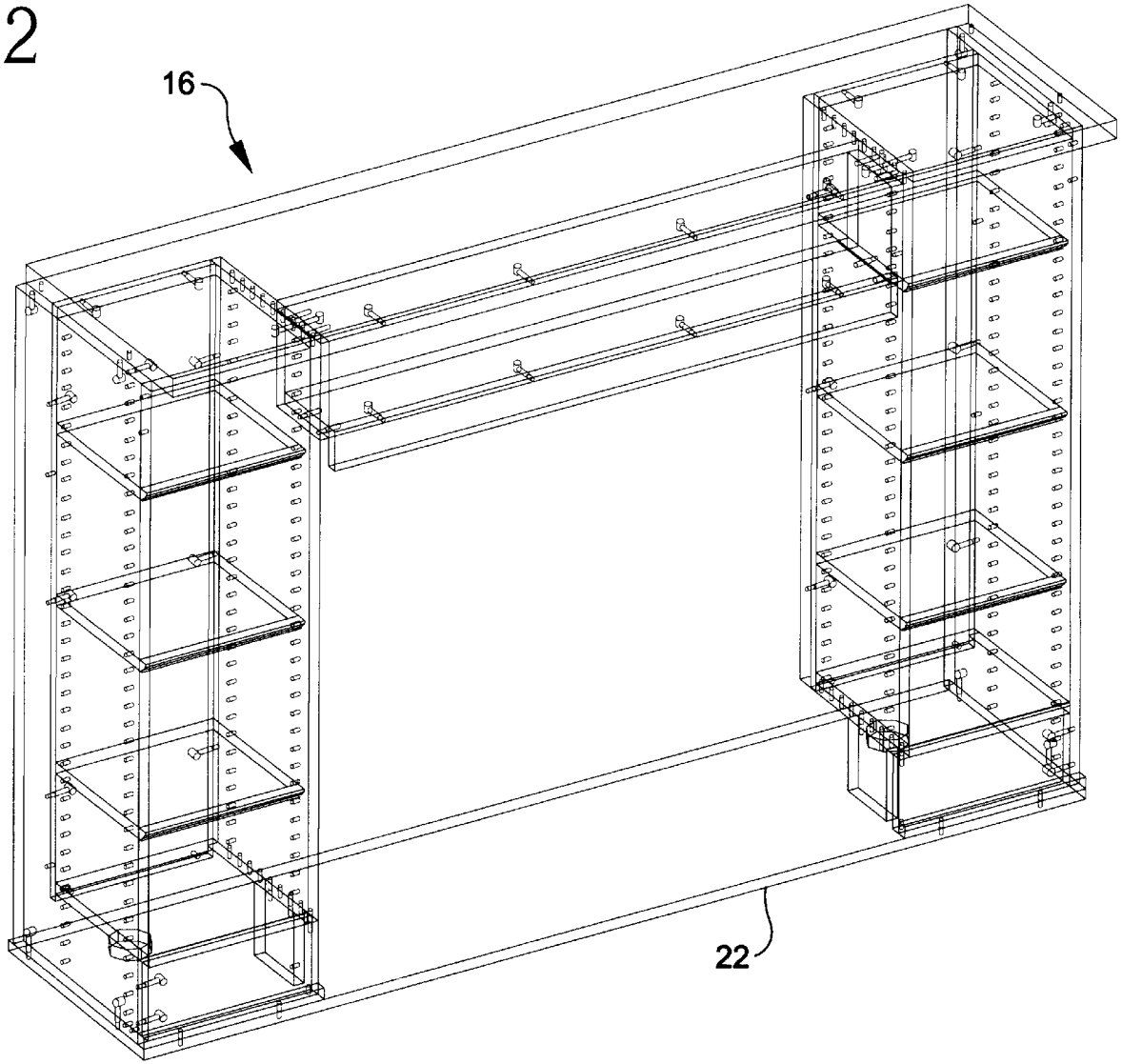
FIGS. 12–12*a* are perspective views of the fireplace cabinet unit.
Figure 12A:
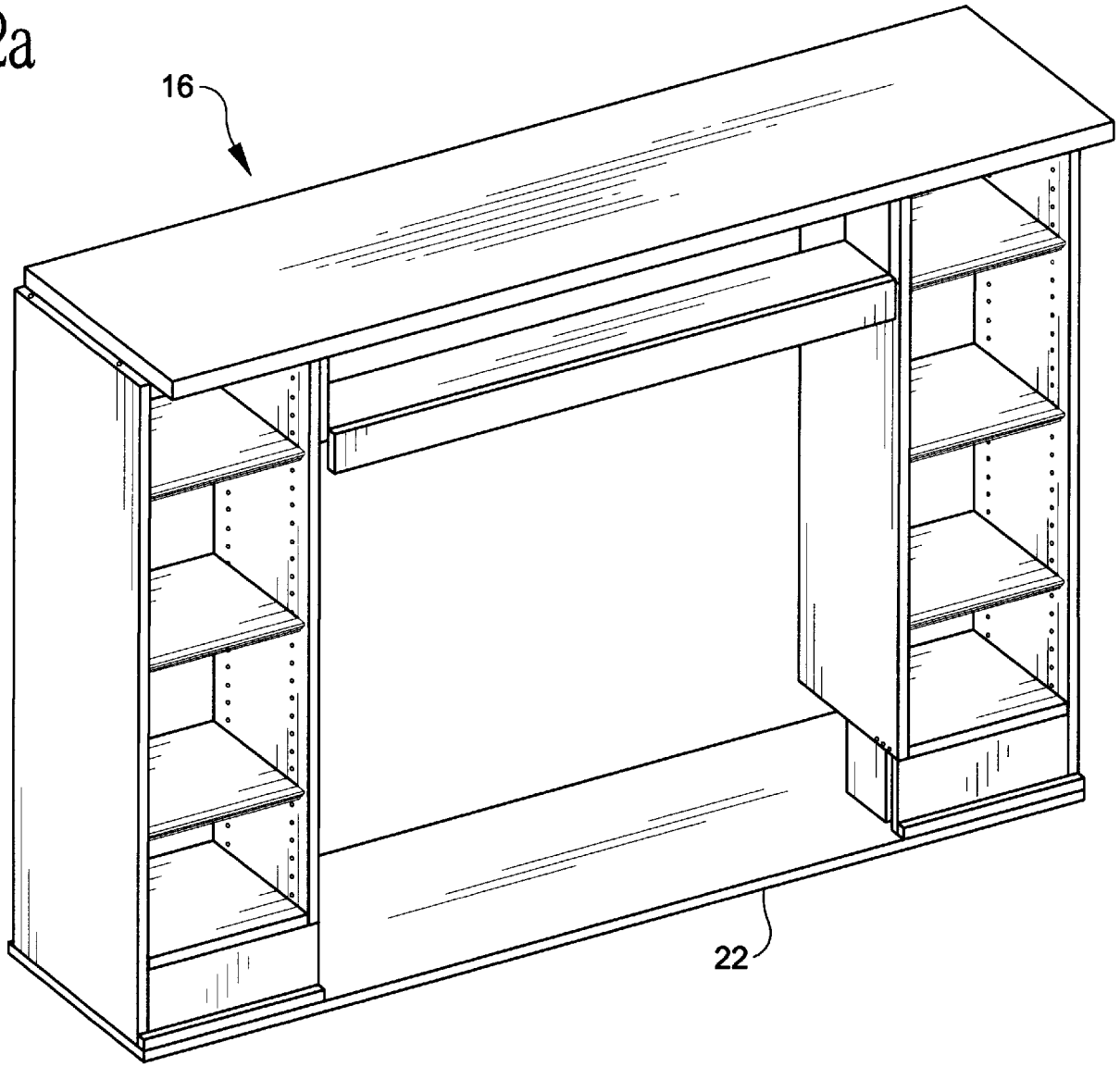
Figure 13:
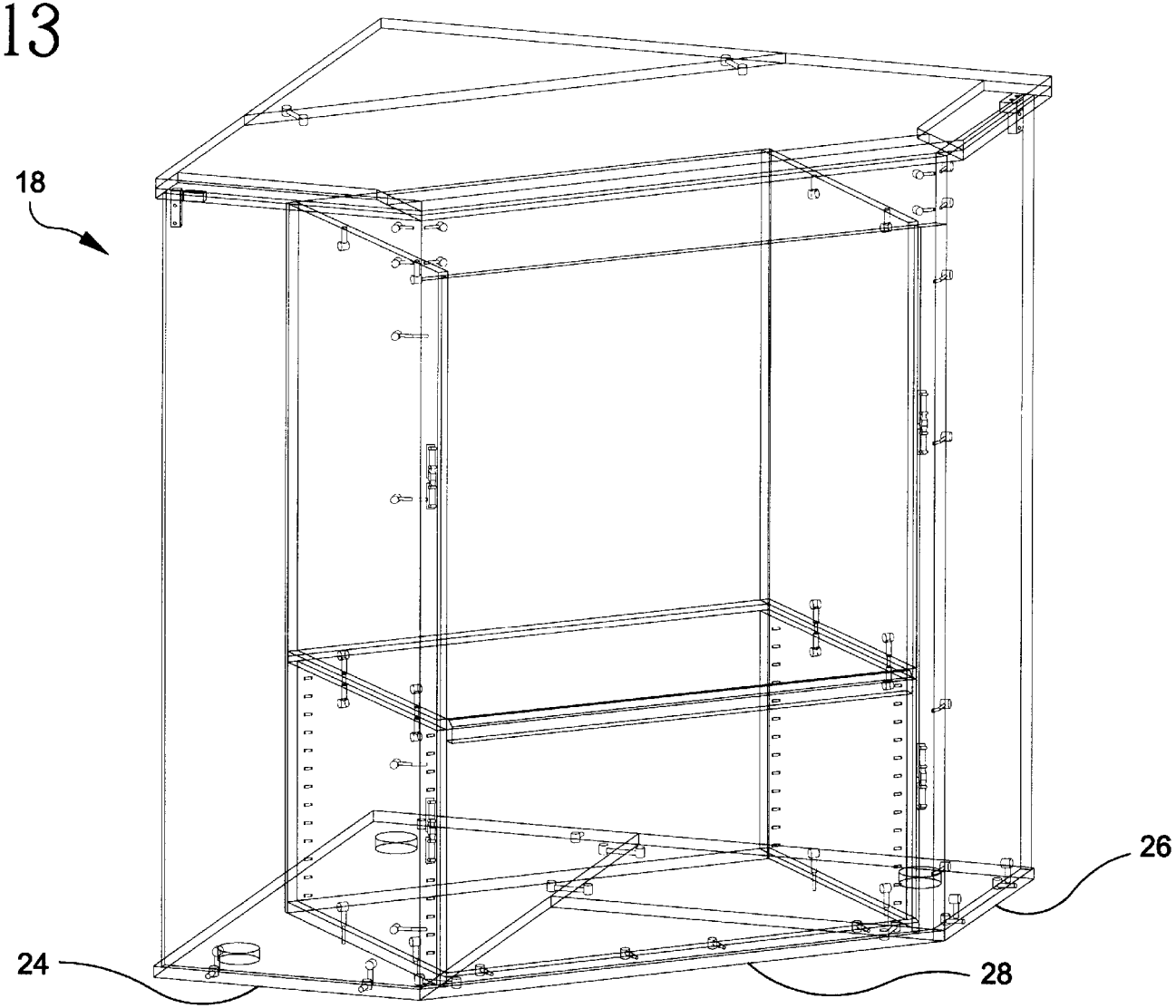
FIGS. 13–13*a* are perspective views of the corner cabinet unit.
Figure 13A:
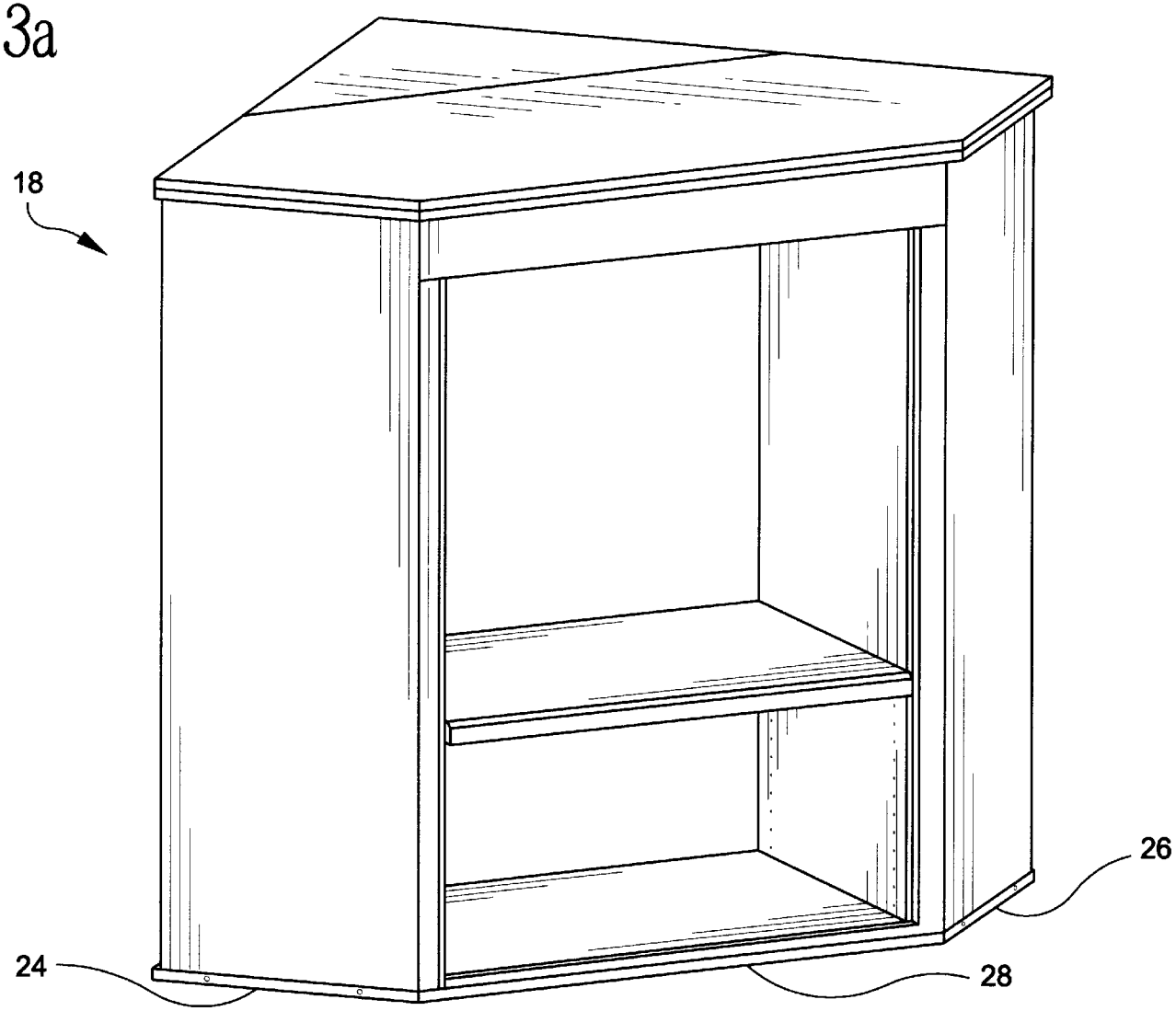
Figure 14:
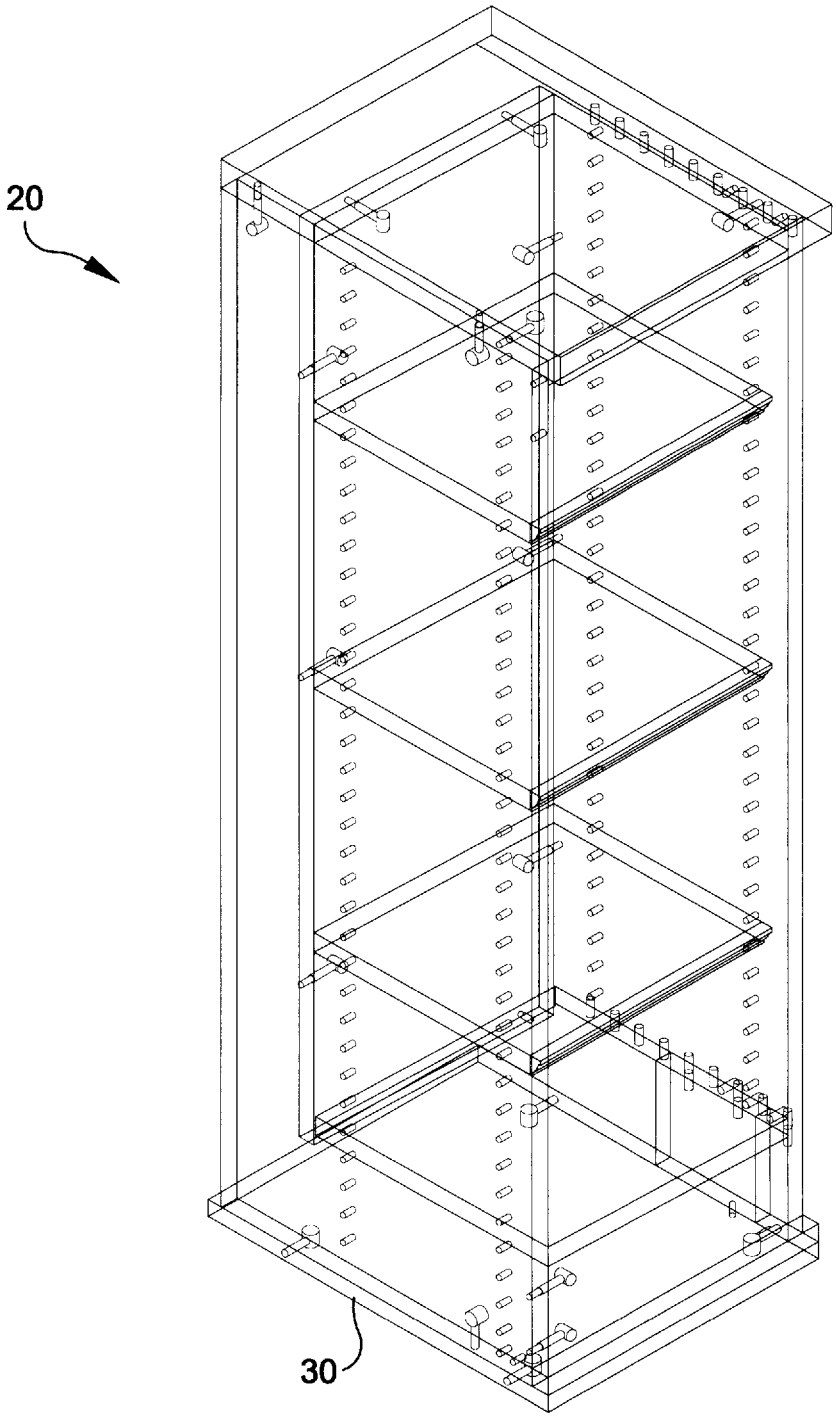
FIGS. 14–14*a* are perspective views of the bookcase cabinet unit.
Figure 14A:
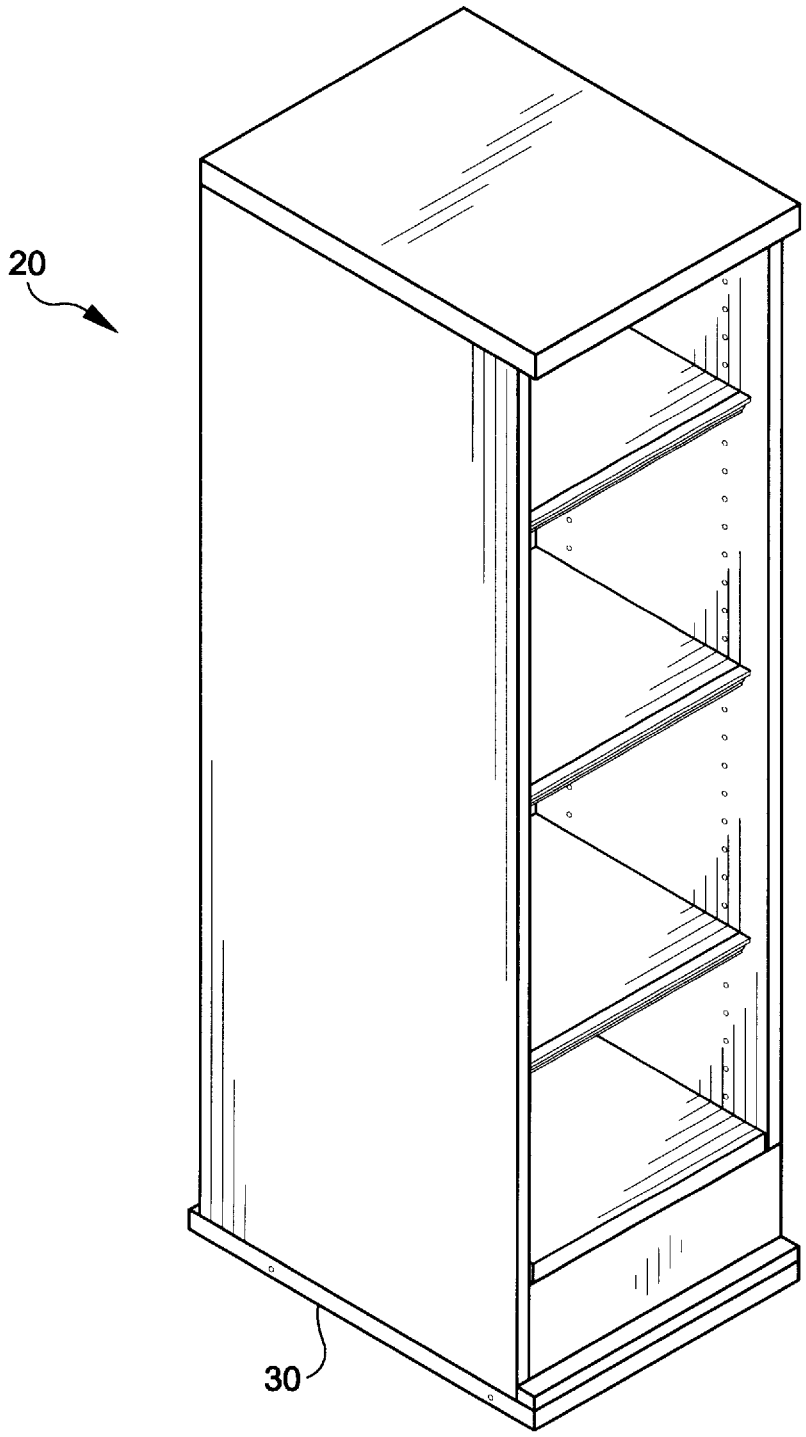

The fireplace system of the present invention additionally provides a great deal of installation flexibility. More particularly, by utilizing the three components shown in FIG. 1, i.e., fireplace cabinet unit 16, corner cabinet unit 18 and bookcase cabinet unit 20, a variety of installations may be accomplished. FIGS. 10*a* to 10*g* illustrate just a few of the possible configurations. Each of these installations, however, utilizes and relies on the installation template. For installations in which the gas fireplace is installed in the corner cabinet unit, templates 24, 26, and 28 (shown in detail in FIG. 11), include the necessary indicia (guidelines, instructions) thereon. Moreover, the templates include drywall flanges 40' and 40" secured thereto. The templates also include access openings 52' and 54'. Access openings 54' are initially covered by removable knockouts 55'. In a corner installation, the gas fireplace unit may be set on a reinforced shelf within the cabinet. In this arrangement, the template (which is secured to the floor) determines the precise position of reinforced shelf which, in turn, determines the precise position of the subsequently-installed fireplace unit. The fireplace system of the present invention is also suitable for use in "already constructed" homes. In these retrofit applications, any floor covering is first removed from the area which will receive the fireplace and associated cabinet (s). The existing drywall is then marked as to allow a ¾" slot (the thickness of the template) to be removed along the bottom of the drywall, thus allowing the rearward edge to slide under the existing wall into abutting contact with the studs of the wall. The remaining installation is similar to the new home installation, with the exception that the plumber and/or electrician may need to cut a hole through the existing drywall at the location defined by access opening 54.

Figure 15:
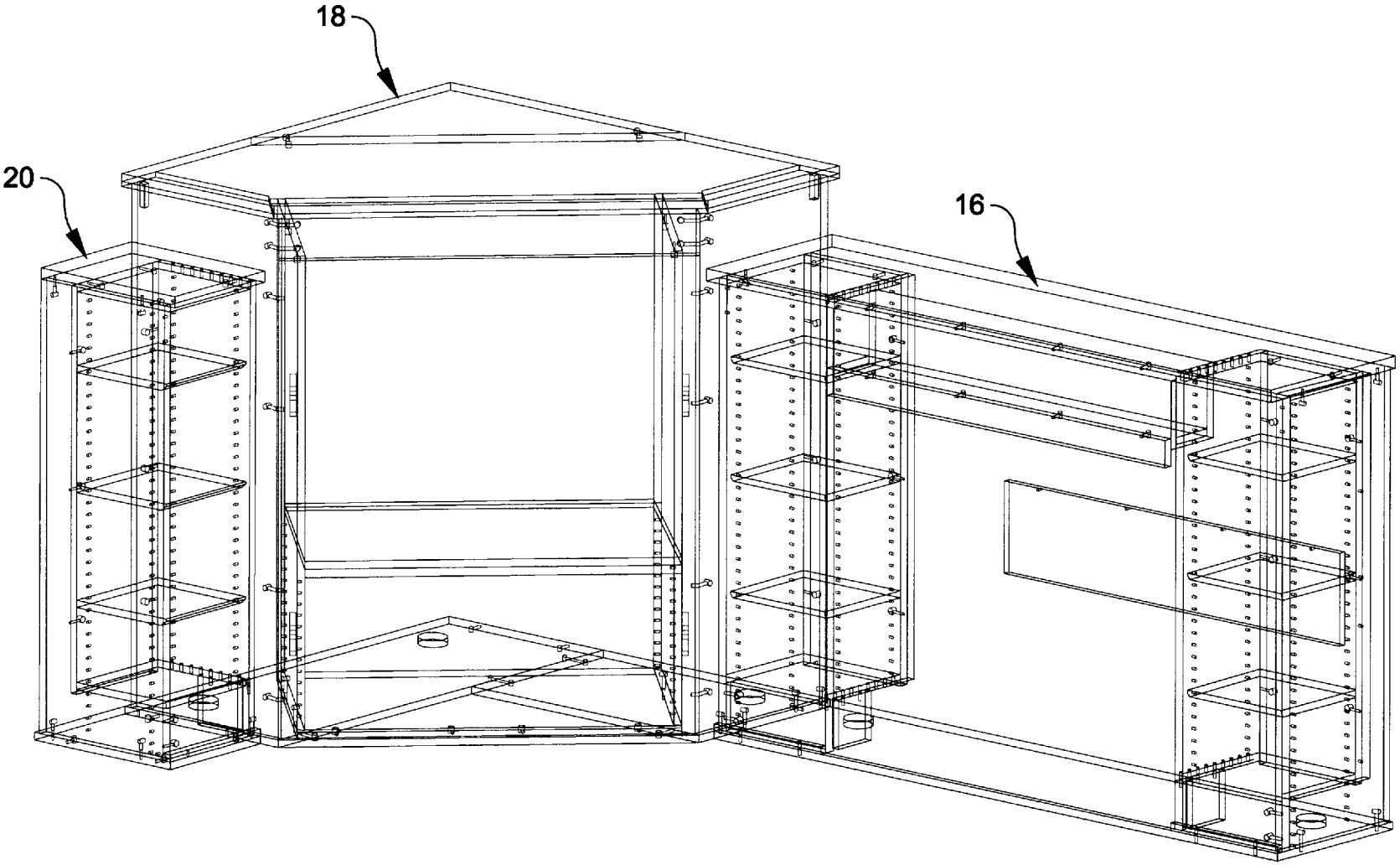
FIG. 15 is a perspective assembly view of the cabinet units of the present invention.

The cabinetry used in connection with the gas fireplace system of the present invention is shown in greater detail in FIGS. 12–14*a*. As shown, the cabinets are manufactured in component pieces to facilitate packaging and shipping of the units. These component pieces are thereafter readily assembled about the gas fireplace, and are readily connected to the base templates and to the adjoining cabinets, if any. As discussed hereinabove, this assembly may be accomplished by use of rotatable camlocks and camlock pins. The templates, templates 22–30, are formed as separate pieces, and packaged together with the associated cabinetry. It is contemplated herein that the template itself could be manufactured as one integral component, thereby eliminating the need to secure the various template pieces together in a fireplace system such as system 10 shown in FIG. 1. Finally, FIG. 15 illustrates the interconnection of the various cabinet units, although in this figure the fireplace cabinet unit 14 is shown positioned on the right hand side of cabinet unit 18 (in contrast to the positioning shown in FIG. 1).

Thus, while there have been described what are presently believed to be the preferred embodiments of the invention, those skilled in the art will realize that various changes and modifications may be made to the invention without departing from the spirit of such invention. All such changes and modifications which fall within the scope of the invention are therefore intended to be claimed.

What is claimed is:

1. A template for facilitating installation of a gas fireplace unit in a building, said building including a floor and at least one wall positioned substantially perpendicular to said floor, said wall including a plurality of vertically-disposed studs adapted for subsequent attachment of drywall thereto, comprising:

a planar panel having an upper surface for receipt of said gas fireplace unit thereon, a lower surface for engagement with said floor and a rearward edge for abutment against said studs, said upper surface including means for locating said gas fireplace at a predetermined position thereon;

a drywall cavity sized for receipt of drywall therein located along said rearward edge of said panel; and at least one predefined access opening adapted for passage of a gas line therethrough.

2. The template according to claim 1, further comprising an L-shaped drywall flange secured to said upper surface of said panel proximate said rearward edge defining said drywall cavity.

3. The template according to claim 2, wherein said predefined access opening comprises a removable knockout formed in said drywall flange.

4. The template according to claim 1, wherein said predefined access opening comprises a precut aperture from said upper to said lower surface of said panel.

5. The template according to claim 1, wherein said locating means comprises indicia positioned on said upper surface, said indicia including transverse and lengthwise measuring marks to facilitate centering of said gas fireplace unit on said template.

6. The template according to claim 1, wherein said indicia further includes trade instructions to facilitate subsequent plumbing and electrical connections.

7. The template according to claim 1, wherein said panel further comprises at least one camlock fastening system adapted to allow subsequent attachment of an adjacent component thereto.

8. The template according to claim 1, wherein said template is formed of a material selected from the group consisting of fiberboard and plywood.

9. A fireplace system for installation in a building including a floor and at least one wall positioned substantially perpendicular to said floor, said wall including a plurality of vertically-disposed studs, comprising:

a gas fireplace unit;

a first template including:

a planar panel having an upper surface for receipt of said gas fireplace unit thereon, a lower surface for engagement with said floor and a rearward edge for abutment against said studs, said upper surface including means for locating said gas fireplace unit at a predetermined position thereon; and a drywall cavity sized for receipt of drywall therein located along said rearward edge of said panel; and a first cabinet surrounding said gas fireplace unit and secured to said first template.

10. The system according to claim 9, wherein said template further comprises at least one access opening, and wherein said access opening is located at a predefined position as to allow passage of a gas line therethrough without obstructing subsequent attachment of said first cabinet to said first template.

11. The system according to claim 9, wherein said locating means comprises indicia positioned on said upper surface, said indicia including transverse and lengthwise measuring marks to facilitate centering of said gas fireplace unit on said template.

12. The system according to claim 9, wherein said panel further comprises at least one camlock fastening system for fastening of said first cabinet to said first template.

13. The system according to claim 12, wherein said camlock fastening system includes at least one rotatable cam lock and at least one camlock pin, said panel including a blind hole for insertion of said rotatable camlock therein, said panel further including a passage extending from an edge of said panel to said blind hole sized for insertion of said camlock pin therein whereby said camlock pin cooperates with said rotatable camlock to lock said camlock pin in said passage.

14. The system according to claim 9, further comprising a second template and a second cabinet sized for attachment to said second template, and wherein said second template is secured to said first template, and wherein said second cabinet is attached to said second template and to said first cabinet.

15. A method of installing a gas fireplace unit in a building, said building including a floor and at least one wall having a plurality of vertically-disposed studs, comprising:

a) providing a template, said template including a planar panel having an upper surface for receipt of said gas fireplace unit thereon, a lower surface for engagement with said floor and a rearward edge for abutment against said studs;

a drywall cavity sized for receipt of drywall therein located along said rearward edge of said panel; and said upper surface including means for locating said gas fireplace unit at a predetermined position thereon;

b) locating said template on said floor of said building and thereafter positioning said rearward edge into abutting contact with said studs of said wall;

c) securing said template to said floor;

d) locating said fireplace unit at said predetermined position on said panel; and e) running a gas line through a predefined opening in said template and thereafter connecting said gas line to said fireplace unit.

16. The method according to claim 15, wherein said step of locating said fireplace unit includes the further step of anchoring said fireplace to said template.

17. The method according to claim 15, further comprising the step of attaching drywall to said studs, a portion of said drywall being inserted into said drywall cavity.

18. The method according to claim 15, further comprising the step of installing at least one electrical connection at a predefined location with respect to said template.

19. The method according to claim 15, further comprising the step of installing cabinetry about said fireplace unit and thereafter securing said cabinetry to said panel.

20. The method according to claim 19, wherein the step of installing cabinetry includes the further step of camlocking said cabinetry to said panel.

* * * * *